United States Patent [19]

Clement

[11] Patent Number: 4,843,988

[45] Date of Patent: Jul. 4, 1989

[54] STEPPED BOTTOM FOR BOAT

[76] Inventor: Eugene P. Clement, 104 Woodward Ave., Asheville, N.C. 28804

[21] Appl. No.: 77,437

[22] Filed: Jul. 24, 1987

[51] Int. Cl.[4] ..... B63B 1/06

[52] U.S. Cl. ..... 114/56; 114/291

[58] Field of Search ..... 114/56, 57, 271, 274, 114/291

[56] References Cited

U.S. PATENT DOCUMENTS

| | | | |
|---|---|---|---|
| 3,149,351 | 9/1964 | Plum . | |
| 3,763,810 | 10/1973 | Payne | 114/291 |
| 3,802,370 | 4/1974 | Collier | 114/291 |
| 3,807,337 | 4/1974 | English et al. | 114/291 |
| 3,996,869 | 12/1976 | Hadley | 114/291 |
| 4,644,890 | 2/1987 | Lott | 114/61 |

*Primary Examiner*—Sherman D. Basinger
*Assistant Examiner*—Stephen P. Avila

[57] ABSTRACT

A design for the bottom of a boat is provided which has particular applicability for the case of single-screw planing boats. The invention comprises stepped regions in each after outboard corner of the hull bottom which are sized and configured so as to give a substantial reduction in wetted bottom area, while at the same time avoiding encroaching on those two regions of the hull bottom which it is desirable to have remain in contact with the water surface in the planing condition. The first of these bottom regions which it is important to have remain wetted is a narrow arrowhead-shaped band which begins at the forward boundary of the region of the bottom which is wetted by solid water at high speed and extends for a short distance aft. This is the region of high pressure on the bottom of the boat which supports its weight in the planing condition. The second region of hull bottom which it is important to have remain wetted is that region down the middle of the boat which is above the propeller, propeller shaft, strut, and rudder. This is so that these items are shielded from the passage of ventilating air down from the surface, and are thus enabled to operate at maximum efficiency, and also so that they are prevented from causing undesirable spray and turbulence in the wake behind the boat. The configuration has the further advantage that a substantial reduction in wetted bottom area is achieved without reducing the wetted length in the planing condition, which would tend to cause porpoising.

8 Claims, 2 Drawing Sheets

STEPPED BOTTOM FOR BOAT

BACKGROUND OF THE INVENTION

The present invention relates generally to the field of motor boats and particularly to those intended to be operated at high speed.

A motor boat which is intended to be operated at high speed will generally be of the planing type and should be so designed as to have low resistance in the high speed planing condition. When the resistance is low, then the desirable features of low values of engine power, boat cost, and fuel consumption rate are achieved. An important additional benefit is conferred when a planing boat intended for towing water skiers has low resistance at high speed. For this application a minimum of turbulence in the wake behind the boat is desirable. With reduced resistance,the propulsive effort required from the propeller is lessened, and the turbulence in the wake behind the boat, resulting from the propeller action, will be beneficially diminished.

Now, it should be stressed that in a representative case of a boat planing at a speed of 45 mph, the primary source of resistance is the frictional drag on the hull bottom as the boat slides over the surface of the water. Typically, the frictional resistance will then account for about 85% of the hydrodynamic hull drag. Furthermore, the frictional resistance is directly proportional to the magnitude of the hull bottom area that is wetted in the planing condition. Again, typically, at a speed of 45 mph each square foot of wetted bottom area produces nearly 10 pounds of resistance; and at 55 mph each square foot of wetted bottom area produces nearly 15 pounds of resistance.

In the past, designers of planing motor boats have tried various configurations of steps in the hull bottoms, in an attempt to separate the flow from portions of the bottoms, and thereby achieve a reduction in the extent of wetted bottom area, and consequently in resistance. For a variety of reasons these solutions have been unsatisafctory, and therefore practically all fast planing boats are of the unstepped type—despite the fact that their large magnitudes of bottom wetted area result in high values of resistance at high speeds.

One of the unsuccessful practices of the past has been to introduce an essentially transverse step in such a way that all of the hull bottom behind the step is clear of the water surface at high speed. This configuration is unsatisfactory because reducing the wetted area in this manner also results in a shortening of the planing surface, which tends to cause porpoising. Also, stepped bottom configurations in which the aftermost part of the hull bottom behind the step is in contact with the water surface were found wanting because no single position of this rear surface is suitable for the different speeds, loads, and water surface conditions at which a boat operates. This finding led to the introduction of rear planing surfaces which could be adjusted to suit the various conditions; however, this solution has the drawbacks of increased cost and complexity, and therefore has failed to find acceptance and utilization.

In addition to the drawbacks mentioned above, the various stepped boat designs of the past are found to have further shortcomings when applied to inboard-powerd boats for towing water skiers. For this application, a relatively smooth, turbulence-free wake is a primary desideratum. One of the necessary preconditions for this result is for that portion of the hull bottom which is above the shaft, strut, propeller, and rudder, to remain in contact with the water surface. This requirement is not satisfied by the various stepped designs of the past, because they leave one or more of the appendages (shaft, strut, or rudder), uncovered and piercing the free water surface. In this condition they produce undesirable amounts of spray and turbulence in the wake behind the boat. Furthermore, the propeller will lose effectiveness if it is not covered by a region of hull bottom which is in contact with the water surface, since if it is uncovered it will tend to draw ventilating air down from the free surface. In this condition the propeller will also produce an undesirable air-filled wake. The shaft, strut, and rudder will also tend to draw air down from a free water surface, particularly when the boat is turning. In the case of the strut, this will aggravate ventilation of the propeller, and in the case of the rudder, both its effectiveness in providing directional stability and in providing a side force during turns will be impaired.

Another unsatisfactory and unsuccessful past practice has been to introduce into the bottom of a planing boat a transverse step together with a pair of inwardly converging diagonal side steps. This configuration, which is shown in U.S. Pat. No. 3,149,351, is unsatisfactory in several respects. First, because it shortens the planing surface it causes porpoising. Second, the straight diagonal side steps depicted in the referenced patent form an angle of approximately 160 degrees at their junctures with the chines. Now, at intermediate speeds water flowing along the sides of the hull will not separate at such junctures, but will instead adhere to them by suction, and will therefore continue to wet the faces of these side steps and also the bottom regions behind these steps. Accordingly, the desired flow separation from the bottom regions behind the steps will not be achieved. A further drawback is that the straight diagonal steps depicted in the referenced patent meet the chines at 32 percent of the hull bottom length forward of the stern. This intersection point is much too far forward. It will result in the bottom edge of each step being crossed by the line of the forward boundary of the wetted region of the bottom of the boat when it is planing at high speed. In this situation the flow will reattach to the hull bottom behind each step, and therefore the desired reduction in hull bottom wetted area will not be achieved. The line of the forward boundary of the wetted bottom region as shown in the referenced patent is incorrect. It is shown making an angle of 40 degrees with the centerline of the boat (in plan view). In actuatlity this line will typically make an angle of less than 20 degrees with the hull centerline, and this will result in its crossing the diagonal side steps which are shown and described in the referenced patent.

The transverse step of the foregoing configuration has the further drawback that, if utilized for an inboard-powered boat, it will leave the rudder and propeller without a covering by wetted hull bottom area. In this condition they will lose effectiveness, and also produce excessive spray and turbulence in the wake behind the boat. The sharp corners at the junctures between the diagonal side steps and the transverse step, which are indicated in the referenced patent, also have the drawback that each of these corners will produce a ridge of water in the wake behind the boat, thereby disturbing the desired smooth wake.

OBJECTS AND ADVANTAGES OF THE INVENTION

It is therefore an object of the present invention to provide a stepped bottom for a boat which will give a substantial reduction in wetted bottom area without reducing the length of the wetted bottom region, since reducing the length of this region will tend to cause porpoising. It is also an object to provide a stepped bottom for a boat which will give a substantial reduction in wetted bottom area without introducing a need for an adjustable rear planing surface. It is a further object to provide a stepped bottom for a boat which will give a substantial reduction in wetted bottom area without encroaching on that important area of high bottom pressure near the forward boundary of the wetted region, which serves the important function of supporting the weight of the boat in the planing condition. It is a still further object to provide a stepped bottom for a boat which will give a substantial reduction in wetted bottom area, and at the same time will result in water remaining in contact with that region of the hull bottom which is above the shaft, strut, propeller, and rudder; thereby ventilation of these items will be prevented and they will accordingly operate at maximum effectiveness. It is a still further object to provide a stepped bottom for a boat which will give a substantial reduction in wetted bottom area, and at the same time will produce a wake behind the boat which is smooth and also free of spray and air-filled or other undesirable turbulence. It is a still further object to provide a stepped bottom for a boat which will give a substantial reduction in wetted bottom area at intermediate as well as at high speeds.

Other and further objects of the invention will become apparent upon reading the detailed specification hereinafter following and by referring to the drawings annexed hereto.

DESCRIPTION OF DRAWINGS

Suitable embodiments of the invention are shown in the attached drawings wherein:

FIG. 4 is a partial longitudinal sectional view taken along line 4—4 in FIGS. 2 and 3.

FIG. 5 is a transverse sectional view taken along line 5—5 in FIG. 2.

FIG. 6 is a transverse sectional view taken along line 6—6 in FIGS. 2 and 3.

FIG. 7 is a transverse sectional view taken along line 7—7 in FIGS. 2 and 3.

Numeral references are employed to designate the various parts shown in the drawings, and like numerals indicate like parts throughout the drawings.

DESCRIPTION OF THE PREFERRED EMBODIMENTS

Figure 1:
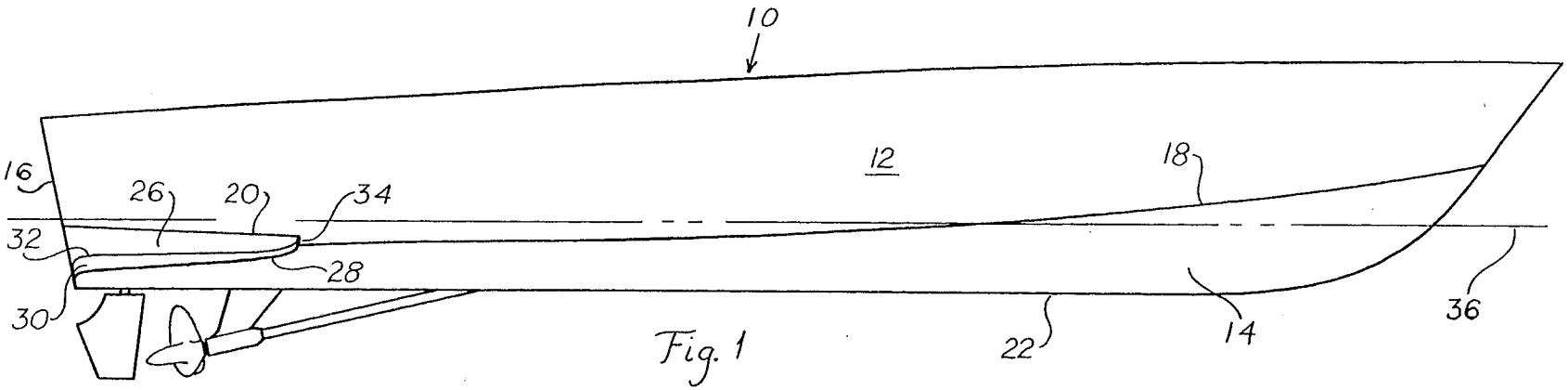
FIG. 1 is a side elevational view of a boat hull incorporating the preferred embodiment of the invention.

The numeral 10 generally indicates the hull of the boat, and the numeral 12 indicates a side of the hull. The numeral 14 indicates the bottom of the hull, and the numeral 16 indicates the stern transom of the hull.

The hull bottom is generally bounded and defined by the forward and after chines 18 and 20, the centerline keel 22 and the lower edge 24 of the stern transom 16.

Figure 2:
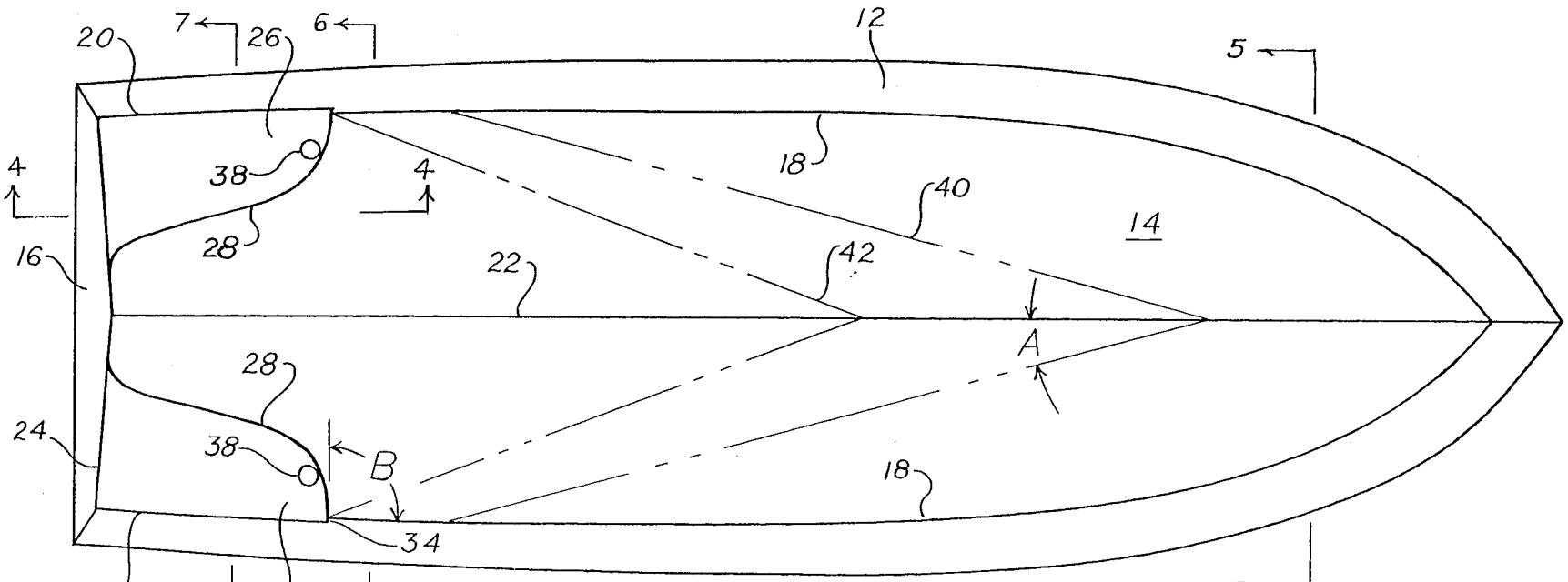
FIG. 2 is a bottom plan view of the boat hull incorporating the preferred embodiment of the invention.
Figure 4:
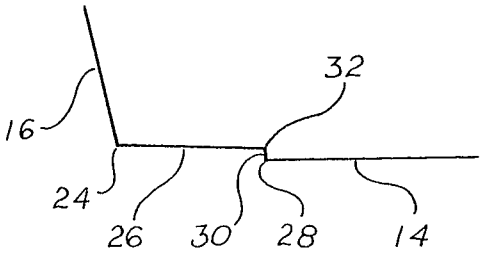
FIGS. 4 through 7 are sectional views; they are simplified by eliminating the structure, and they show only the outside envelope of the hull.
Figure 5:
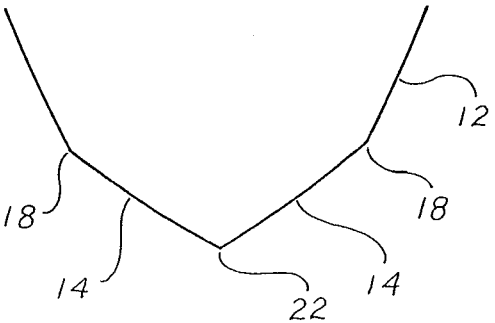
Figure 6:
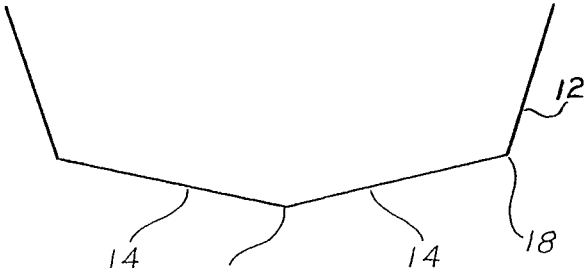
Figure 3:
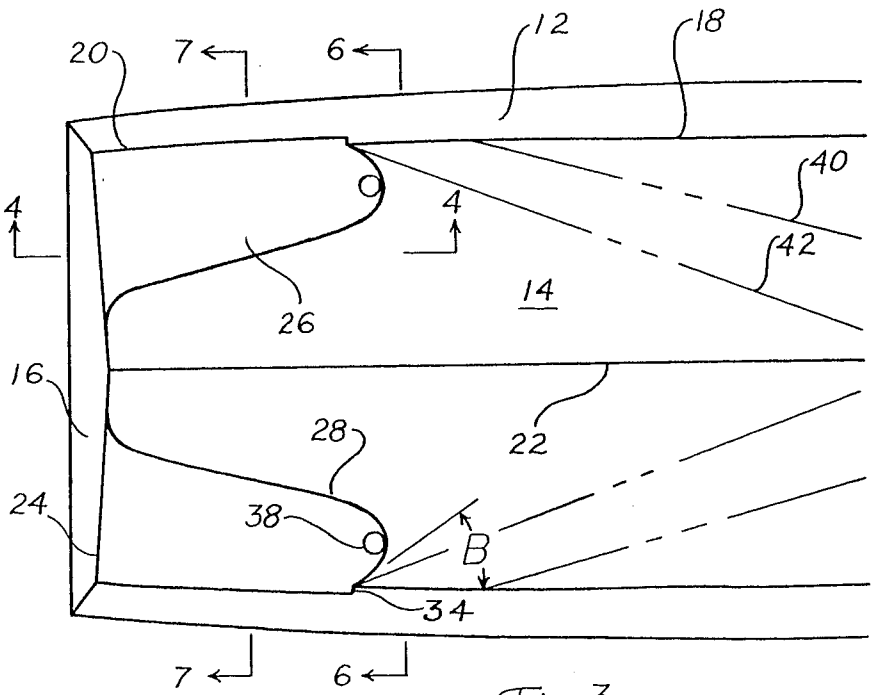
FIG. 3 is a bottom plan view of the stern portion of a boat hull incorporating an alternative embodiment of the invention.
Figure 7:
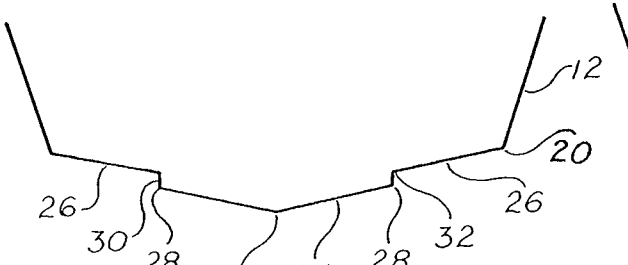

A pair of stepped regions 26 are formed in the rear outboard corners of the hull bottom by a pair of steps which in plan view appear approximately as elongated S-shaped curves. In this view they are curved concavely aft near their forward ends, and convexly aft near their after ends. Each step has a lower edge 28, a face 30, an upper corner 32 and a side edge 34. Each step lower edge 28 begins at the aft end of a foward chine 18 and terminates at the transom lower edge 24. The upper corner 32 of each step begins at the forward end of an after chine 20 and ends at the transom 16. As shown in FIGS. 1, 2, 3, 4, and 7, each stepped region 26 is a generally flat or plane surface located upwardly of the hull bottom 14.

The numeral 38 indicates the opening of a vent pipe which leads from inside the hull, above the waterline, to the forward end of each stepped region 26.

OPERATION OF THE INVENTION

The operation and function of the boat incorporating the novel stepped bottom design described herein is as follows:

When the boat is at rest, the water line is indicated by the numeral 36. Accordingly the stepped regions 26, and all the parts, 28, 30, 32, and 34, of the steps, are submerged.

As the boat is accelerated forwardly it changes from an initial displacement condition into a transition condition which is intermediate between displacement and planing, and finally into a fully planing condition. At intermediate speeds of 15 to 20 miles per hour the water flowing along the sides of the hull will no longer flow around the corners corresponding to the side edges 34 of the steps, and from there onto the faces of the steps 30; instead, with the corner angle B of less than 140 degrees, as taught by the present invention, the water will separate at the corners at intermediate speeds, leading to a separation of the flow from the faces 30 of the steps, and from a portion of the stepped bottom regions 26 behind the steps. This separation of the flow will be assisted by a flow of air through the vent pipe openings 38 into the regions behind the steps, and will lead to a reduction in wetted bottom area, and hence also in resistance. This reduction in resistance will result in an increase in the available net accelerating force, and hence also to an increase in the acceleration rate of the boat.

When the fully planing condition.is reached, at about 30 miles per hour, the stepped bottom regions 26 will be entirely above the water surface, so that a large reduction in wetted bottom area, and hence also in resistance will be achieved.

The boat will run in a stable manner up to very high speeds because the length of the planing surface has not been reduced by this manner of reducing the bottom wetted area. Furthermore, since the shaft, strut, propeller, and rudder are covered by a region of hull bottom area which is in contact with the water surface they will not tend to ventilate, but instead will operate at maximum effectiveness. With this covering they will also produce a minimum of disturbance in the wake behind the boat. The curved ahape of the step edges in plan view, with no sharp corners, will also contribute to the smooth shape of the wake behind the boat.

When the boat is running at high speeds of about 45 miles per hour and faster, the forward boundary of the region of the hull bottom which is wetted by solid water will be at the boundary line indicated by the numeral 40. The angle A formed by this boundary line with the centerline keel, in plan view, will typically be about 15 degrees. Now, when a motor boat is planing at high speed the water pressure on the bottom which supports the weight of the boat occurs in a relatively narrow arrowhead-shaped band on the hull bottom. The forward boundary of this region of high pressure coincides with the forward boundary of the bottom region which is wetted by solid water, i.e., the boundary line indicated by the numeral 40. The aft boundary of this region of high pressure, which serves the needed function of supporting the weight of the boat, will typically be along the line indicated by the numeral 42 in the drawings. Accordingly it can be seen that an important aspect of the embodiments of the present invention are that they achieve large reductions in bottom wetted area, but without encroaching on the critical bottom region which is needed to support the weight of the boat.

What is claimed is:

1. In a boat hull having a bottom bounded by longitudinally extending chines and an approximately transverse stern; a stepped region in each after outboard corner of said bottom; each said stepped region being defined in plan view by a lower step edge which at its forward and outboard end intersects the adjacent one of said chines at a point less than 22 percent of the length of said bottom forward of said stern (whereby said stepped regions do not encroach on the region of high pressure on said bottom which supports the weight of said boat at high speeds), and forms at this intersection an angle of less than 140 degrees with that portion of said adjacent chine which is immediately forward of said intersection (whereby flow is made to separate cleanly from said hull at said intersection); furthermore each said lower step edge intersecting said stern at a point outboard of the centerline of said boat hull, so that said bottom extends to said stern and is not shortened by said stepped regions.

2. The combination called for in claim 1 wherein a portion of each said lower step edge is curved concavely aft in plan view, thereby enlarging each said stepped region while keeping in place the ends of said lower step edge.

3. The combination called for in claim 1 wherein a portion of the after region of each said lower step edge is curved convexly aft in plan view, thereby smoothing the wake behind said intersection of said lower step edge and said stern when said boat hull plantes.

4. The combination called for in claim 2 wherein a portion of the after region of each said lower step edge is curved convexly aft in plan view, thereby smoothing the wake behind said intersection of said lower step edge and said stern when said boat hull planes.

5. In a boat hull having a bottom bounded by longitudinally extending chines and an approximately transverse stern; a stepped region in each after outboard corner of said bottom; each said stepped region being defined in plan view by a lower step edge which at its forward and outboard end intersects the adjacent one of said chines at a point less than 22 percent of the length of said bottom forward of said stern (whereby said stepped regions do not encroach on the region of high pressure on said bottom which supports the weight of said boat at high speeds), and forms at this intersection an angle of less than 140 degrees with that portion of said adjacent chine which is immediately forward of said intersection (whereby flow is made to separate cleanly from said hull at said intersection); wherein furthermore a portion of the forward region of each said lower step edge is curved concavely aft in plan view, thereby enlarging each said stepped region while keeping in place the ends of said lower step edge.

6. The combination called for in claim 5 wherein a portion of the after region of each said lower step edge is curved convexly aft in plan view, thereby smoothing the wake behind said intersection of said lower step edge and said stern when said boat hull planes.

7. In a boat hull having a bottom bounded by longitudinally extending chines and an approximately transverse stern; a stepped region in each after outboard corner of said bottom; each said stepped region being defined in plan view by a lower step edge which at its forward and outbaord end intersects the adjacent one of said chines at a point less than 22 percent of the length of said bottom forward of said stern (whereby said stepped regions do not encroach on the region of high pressure on said bottom which supports the weight of said boat at high speeds), and forms at this intersection an angle of less than 140 degrees with that portion of said adjacent chine which is immediately forward of said intersection (whereby flow is made to separate cleanly from said hull at said intersection; wherein futhermore a portion of the after region of each said lower step edge is curved convexly aft in plan view, thereby smoothing the wake behind said intersectio of said lower step edge and said stern when said boat hull planes.

8. The combination called for in claim 1, 2, 3, 4, 5, 6, or 7, further comprising means to supply air to each said stepped region near its forward end, said air supply enabling flow to separate from said stepped region at a lower speed, thereby lowering the drag of said boat during acceleration and enabling it to plane with a heavier load.

* * * * *